United States Patent [19]

Patton

[11] 4,397,225

[45] Aug. 9, 1983

[54] STACK DRAFT STABILIZING DEVICE

[75] Inventor: Lawrence C. Patton, Minneapolis, Minn.

[73] Assignee: Perform, Inc., Minneapolis, Minn.

[21] Appl. No.: 277,178

[22] Filed: Jun. 25, 1981

[51] Int. Cl.[3] ..... F23L 17/02

[52] U.S. Cl. ..... 98/66 R; 98/122

[58] Field of Search ..... 98/66, 78, 79, 83, 122

[56] References Cited

U.S. PATENT DOCUMENTS

| | | | |
|---|---|---|---|
| 122,619 | 1/1872 | Lutz | 98/66 R |
| 2,017,562 | 10/1935 | Brown . | |
| 2,030,205 | 2/1936 | Green . | |
| 2,030,825 | 2/1936 | Pembroke . | |
| 2,494,679 | 1/1950 | Ward, Jr. | 98/122 X |
| 2,604,838 | 7/1952 | Traver . | |
| 2,701,999 | 2/1955 | Moran . | |
| 2,711,683 | 6/1955 | Ryder . | |
| 2,818,060 | 12/1957 | Field . | |
| 2,916,983 | 12/1959 | Kinkead . | |
| 3,040,734 | 6/1962 | Field . | |
| 3,315,586 | 4/1967 | Marrapese et al. . | |
| 3,361,051 | 1/1968 | Fair et al. . | |
| 3,685,426 | 8/1972 | Roja | 98/83 |

FOREIGN PATENT DOCUMENTS

| | | | |
|---|---|---|---|
| 322307 | 11/1934 | Italy | 98/122 |
| 546742 | 7/1942 | United Kingdom | 98/122 |

*Primary Examiner*—Albert J. Makay
*Assistant Examiner*—Harold Joyce
*Attorney, Agent, or Firm*—Dorsey & Whitney

[57] ABSTRACT

The present invention involves a draft stabilizing device mounted at the exit end of a draft vent or stack. The device is constructed from first and second cap members made in the form of open-bottomed cones which are substantially broader at their bases than they are high. The cones are joined together at their edges with their axes aligned. The lower cone has a large stack inlet opening at its apex which is connected to a stack. The lower cone also includes a plurality of outlet openings around its periphery. The area of the outlet openings exceeds the cross-sectional area of the stack.

8 Claims, 3 Drawing Figures

STACK DRAFT STABILIZING DEVICE

BACKGROUND OF THE INVENTION

1. Field of the Invention

This invention relates to vent, exhaust stack or chimney structures and, more particularly, to a device for stabilizing the draft in a stack or chimney against varying wind conditions at the exit end of the stack or chimney.

2. Description of the Prior Art

As energy costs have increased, it has been recognized that one method of conserving energy is to avoid losses occurring by movement of air or energy through the walls, ceilings or other boundaries of enclosed structures. This recognition has led to increased interest in insulation, and to weather-tight closures for doors, windows and chimneys. It has also been recognized that combustion systems used to heat enclosed structures can be improved in various ways to reduce energy consumption. This has resulted in new burner or control system designs, damper arrangements and other improvements.

Among the specific sources of energy loss which have been recognized is the loss occurring through vent or exhaust stacks and chimneys. Such stacks are found in homes in connection with hot water heaters or furnace vents, as well as with fireplaces. Such stacks also are found in larger residential or commercial buildings and also in some vehicles. In connection with such stacks it has been recognized that ambient wind conditions influence the flow of air or exhaust gases from such stacks; some remedial devices have been proposed. (See, e.g., U.S. Pat. Nos. 2,701,999; 2,711,683; 2,818,060; 3,040,734; 3,315,586; 3,361,051.) Most stack paths and their attached equipment are designed to have proper draft flow primarily in still air conditions. Such conditions obviously do not always prevail. With most stacks, a strong wind current across the exit end will cause a vacuum and an updraft, pulling more air or exhaust gas up the stack than under normal draft conditions. In winter, the air which is pulled up the stack from an inhabited structure is heated and, frequently, humidified. Loss of such air will necessarily cause a loss of energy and may also cause discomfort. In pulling out the warmed and humidified air, an updraft may also cause cold, outside air to be pulled into the building through cracks or other leaks.

In addition to robbing an inhabited space of warm, humidified air, during the burning or "on" phase of a combustion system a wind-induced updraft may also cause abnormal combustion conditions by pulling excess air into the burner on some types of furnaces. The effect of this will be to disturb the air-fuel ratio and decrease combustion efficiency.

The problems caused by wind-induced updrafts are not limited to cold seasons. In summer, an updraft may suck cooled, possible dehumidified, air up a stack and draw warm, moist air in through cracks or other openings. Even in buildings without air conditioning, an updraft may cause problems by pulling cool basement air up through a furnace draft hood or other opening.

It will be observed that the problems caused by wind-induced updrafts occur in both warm and cold seasons. In addition, they may occur during both the "on" and "off" phases of the combustion system which is served by the stack.

While crosswinds generally cause updrafts, certain other wind conditions may cause downdrafts in a stack. Although it is less likely to involve loss of heated or cooled air, a downdraft may, nonetheless, disturb combustion efficiency or drive exhaust gases into inhabited space. In extreme cases it may even extinguish combustion. Accordingly, a stack should be protected against downdrafts as well as updrafts.

A primary prior solution to the updraft and downdraft problem in stacks is use of a stack damper. A damper may be installed at various points in a draft flow path and be actuated by temperature or other parameters so as to be open for the burning or "on" phase and closed when no burning is occurring. (See, e.g., U.S. Pat. Nos. 4,017,024; 4,020,754.) Such a damper can obviously be of benefit in controlling draft flow during the non-burning phase, but it may do little or nothing to prevent updrafts or downdrafts during the burning cycle. Another disadvantage of a damper is that it generally involves moving parts and sensors which may fail to operate properly under the often harsh conditions of an exhaust stack.

SUMMARY OF THE INVENTION

The present invention involves a device which stabilizes draft in vent or exhaust stacks to minimize the effect of wind in causing updrafts or downdrafts. In accordance with the present invention, a draft stabilizing device is mounted at the exit end of a draft vent or stack having a specified cross-sectional area. The device includes a first cap member in the form of a concave surface having a peak angle of between 130° and 170°. The device also includes a second cap member, also in the form of a concave surface with a peak angle between 130° and 170°. In the preferred embodiment, both concave surfaces are in the form of hollow, open-bottomed cones. The second cap member is joined to the first cap member at the edges of their respective bases, with the concave surfaces facing each other. The second cap member has a plurality of outlet openings around the periphery of its base edge. The total area for these openings is slightly greater than the specified cross-sectional area of the stack. The second cap member also has a stack inlet opening where the peak of the concave surface would be. Attached to this stack inlet opening is means for connecting the exit end of the stack to this opening.

The principal objectives of the invention are: (a) to stabilize the draft in a vent or stack by preventing ambient wind from causing updrafts or downdrafts; (b) to prevent the loss of heated or cooled and humidified air from an enclosed space as a result of updrafts; (c) to promote consistent, efficient combustion in heating systems during their burning phase; and (d) to conserve the heat developed in a heating system during its non-burning phase.

DESCRIPTION OF THE PREFERRED EMBODIMENT

Figure 1:
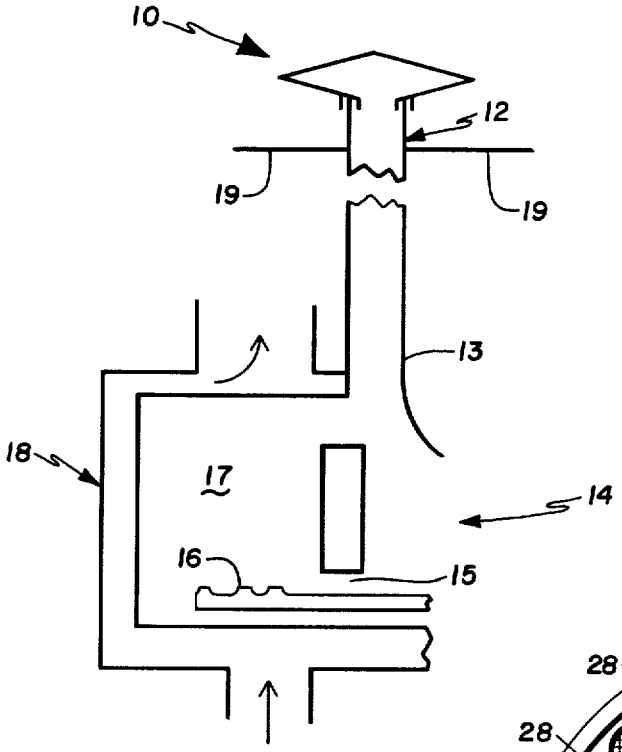
FIG. 1 is a schematic drawing of a furnace system with its exhaust stack, showing the present invention attached to the exit end of the exhaust stack.

As best seen in FIG. 1, the present invention involves a stack draft stabilizing device 10 which is connected to the exit end of a vent or exhaust stack 12. Such a vent or stack 12 is typically part of a combustion system, e.g., a residential heating system 14 such as that shown schematically in FIG. 1. In such a heating system, there is at least one combustion chamber 17 with a burner 16 located near the bottom, typically a gas or oil burner. Air may enter the combustion chamber through an air inlet 15 adjacent the burner 16. The stack 12 is connected to the upper portion of the combustion chamber 17 and provides the escape path for exhaust gases. The stack 12 typically extends upward through the building served by the heating system 14 and passes through a roof 19. In most cases the exit end of the stack 12 will be a cylindrical pipe three to twelve inches in diameter. It may be surrounded by a brick chimney structure. In many heating systems a draft hood 13 is also connected to the top of the combustion chamber 17 at the lower end of the stack 12. Frequently the exhaust vent from a water heater (not shown) will also be connected to the stack 12 somewhere near its lower end. Surrounding the combustion chamber 17 is a heat exchanger 18 through which air, water or some other heated fluid is circulated before being directed to the heated space. The details of construction of the combustion chamber 17, heat exchanger 18 and burner 16 form no part of the present invention and so are not disclosed in greater detail.

Figure 2:
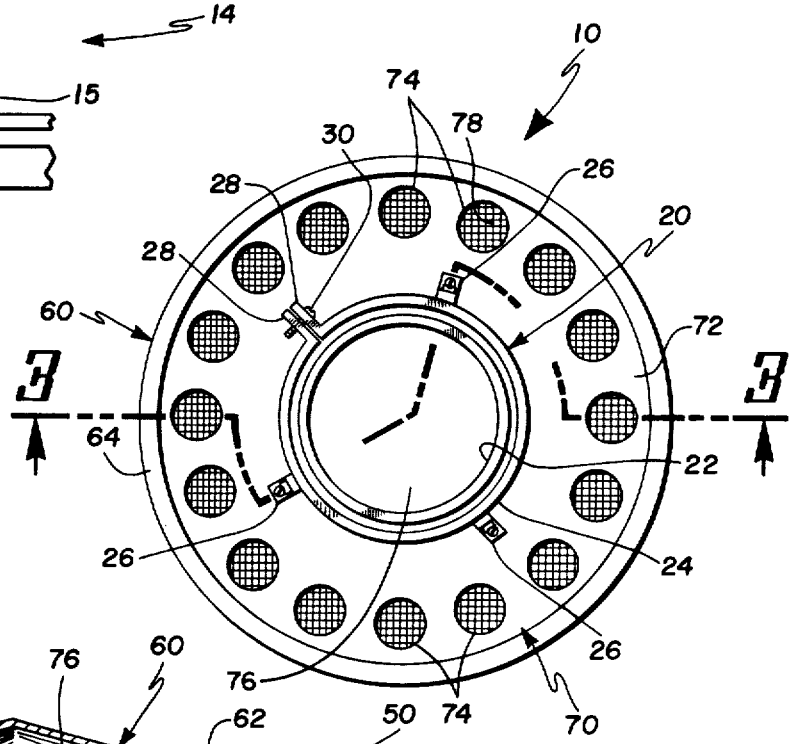
FIG. 2 is a plan view of the present invention as seen when facing the stack attachment portion.
Figure 3:
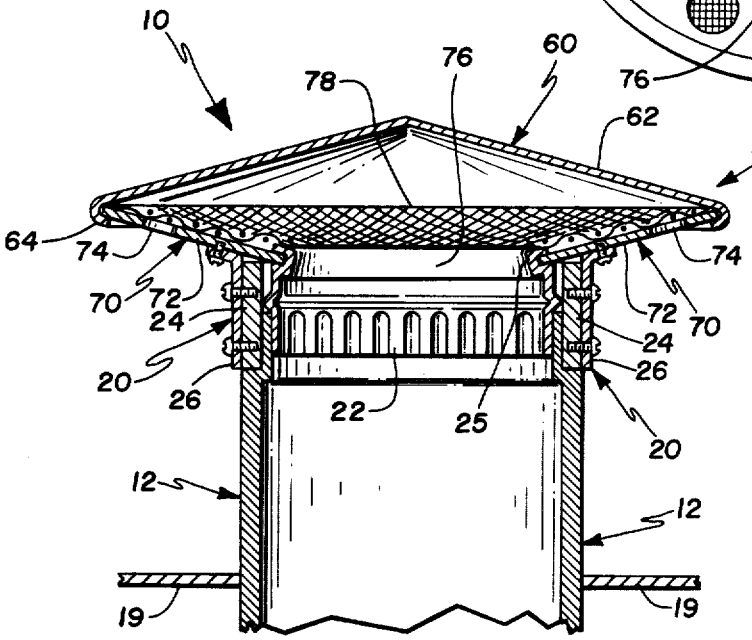
FIG. 3 is a cross sectional view of the present invention taken along line 3—3 of FIG. 2.

Turning now to FIGS. 2 and 3, the structural details of the stack draft stabilizing device 10 may be seen. In general, the device 10 consists of two major subassemblies, a wind control subassembly 50 and a chimney attachment subassembly 20. The wind control subassembly 50 is constructed from upper and lower wind control caps 60, 70, respectively. The upper wind control cap 60 is formed of a sheet 62 of metal or other material of suitable strength and thickness which, in the preferred embodiment, has been stamped or otherwise shaped to have the shape of a cone which is significantly broader across its base than it is high. In the preferred embodiment, the cone formed by sheet 62 has a circular base edge, and the peak angle at the apex of the cone is 150°. The exterior surface of the sheet 62 is substantially smooth, although it may contain a small seam if the cone is formed by joining the edges of a flat sheet of metal.

In the preferred embodiment, the lower wind control cap 70 is formed of a sheet 72 of metal or other suitable material with substantially the same cone shape as the upper wind control cap 60; however, it also includes other features. In particular, the apex of the cone of the lower wind control cap 70 is removed to form a circular stack inlet opening 76 having a diameter substantially equal to that of the stack 12. In addition, the lower wind control cap 70 has a plurality of outlet openings 74 around the periphery, adjacent the edge of the base of the cone. In the preferred embodiment, there are 18 circular outlet openings 74, each approximately one and one-half inches in diameter, equally spaced around the base of the cone. Each opening 74 is, preferably, located such that its center lies at a distance from the apex of the cone which is greater than one-half the total distance between the apex and the base edge.

To join the upper and lower wind control caps 60, 70, respectively, of the preferred embodiment, the base of the upper cap 60 is made slightly larger than the base for the lower cap 70. This permits the edge of the upper cap 60 to be folded over to form a lip 64 which is pinched down against the edge of the lower cap 70. For a typical residential furnace stack application, the diameter of the base of both the upper and lower caps is approximately seventeen inches.

While the upper and lower caps 60, 70 of the preferred embodiment have been described as hollow cones, with circular bases, the invention is not limited to this particular geometric shape. Other concave shapes, such as pyramids or domes which have curved surfaces or piecewise flat surfaces when seen in cross section such as in FIG. 3, may be used. Such surfaces may or may not have a distinct point at their peak. Common to the surface shapes which are most suitable for the present invention are (1) a relatively large "peak angle", by which is meant the angle between two lines which intersect at the peak or deepest point of the concave surface and also pass through two points which are on the line joining the upper and lower caps 60, 70 and on opposite sides of the wind control subassembly 50; and (2) a relatively small angle between the edges of the upper and lower caps 60, 70 near the lip 64 which joins them. With this configuration, a crosswind which strikes the lip 64 of the invention is divided into two parts, flowing along the upper and lower caps, without a great deal of turbulence developing. The crosswind also approaches the outlet openings 74 at an angle, rather than head-on.

While various geometric shapes for the upper and lower caps 60, 70 will results in various degrees of efficiency in draft stabilization, the most effective range for the peak angle appears to be between 130° and 170°. With the conical shapes of the preferred embodiment, this would lead to corresponding angles of between 50° and 10° between the upper and lower caps 60, 70 near the lip 64. For other geometric shapes the angle between the upper and lower caps 60, 70 is not precisely determined by the peak angle. For such shapes an angle of approximately 90° or less between the surfaces of the upper and lower caps 60, 70 near the lip 64 appears most suitable, depending on the width of the surface for which this angle exists before turning toward the peak. Increasing this angle and/or the width of the surface for which it exists increases the wind resistance of the device 10 and may also increase the angle at which the wind approaches the outlet openings 74, depending on the shape of the surface of the lower cap 70; decreasing this angle too much, on the other hand, may tend to choke off draft flow.

An important feature of the present invention is that it has little or no effect on the still-air draft flow characteristics of the stack 12. To ensure this, a specified relationship between the cross-sectional area of the stack 12 and the total cross-sectional area of all of the outlet openings 74 must be maintained. In particular, the total cross-sectional area of all the outlet openings 74 must be slightly greater than the cross-sectional area of the stack 12. In the preferred embodiment, the ratio of the total area of all outlet openings 74 to the area of the stack opening 12 is approximately 1.12-to-1.00. However, the ratio of areas may vary somewhat in either direction from this preferred ratio (for example, up to 1.25-to-1.00), without significantly changing the functioning of the invention, except that a ratio of less than one-to-one would normally not be acceptable.

The interior of the wind control subassembly 50 of the present invention is empty, except that for convenience in keeping small animals or debris from entering the vent openings 74, a piece of wire cloth 78 having small mesh, such as four squares per square inch, may be cut in the shape of a ring and laid on top of the outlet holes 74. For security, the wire mesh 78 may be fastened to the lower wind control cap 70 by machine screws (not shown) or any other suitable means.

Referring still to FIGS. 2 and 3, the stack attachment subassembly 20 of the preferred embodiment may be seen. The stack attachment portion 20 is formed from two substantially concentric rings 22, 24. For a typical residential furnace stack application, each ring is approximately two and one-half inches high. The inner attachment ring 22 is selected to be slightly smaller in diameter than the inner diameter of the stack 12 to which the device 10 is to be attached. This may vary from 3 to 12 inches or larger, depending on the type of vent or stack involved. The inner ring 22 is attached to the stack opening 76 of the lower wind control cap 70 by any suitable means, such as by pinch tabs 25 which are crimped to fasten against the circumference of the stack opening 76.

The outer attachment ring 24 is larger in diameter than the inner ring 22 and is adjustable to fasten snugly against the exterior of the stack 12. For this purpose, the outer ring 24 is formed (in the preferred embodiment) from a ring of sheet metal with two tabs 28 pointing radially outward at a break in the ring 24. Passing through the two tabs 28 is a bolt 30 or other suitable means for drawing the tabs together or moving them apart, thereby decreasing or increasing the diameter of the ring 24. One or more mounting angle brackets 26 are used to fasten the outer ring 24 to the sheet 72 which forms the lower wind control cap 70. Rivets or other fasteners may be used for this purpose.

The preferred embodiment of the present invention is formed from twenty-six gauge galvanized steel sheeting which is cut and pressed to form the appropriate shapes discussed above. This material is adequate for the temperatures and exhaust gas conditions prevailing on a residential chimney. More or less durable materials would be selected for other applications.

To install the draft stabilizing device 10 on a stack 12, the exterior ring 24 is loosened and the device 10 is placed with the inner ring 22 within the exit end of the stack 12. The bolt 28 is then used to tighten the outer closure ring 24 against the exterior of the stack 12. In certain circumstances the stack 12 may not be round, e.g., square chimney tile. In such cases, an adapter may be formed of sheet metal to convert the non-round opening to a round opening of equivalent cross-section.

In most circumstances the device 10 will be mounted such that the plane formed by the connection joint between the upper and lower caps 60, 70 is horizontal. Other orientations may be chosen in order to have the device offer the least resistance to and greatest protection against prevailing winds.

In summary, it can be seen from the above discussion that the present invention offers a simple and inexpensive solution to the problem of stabilizing the draft in a draft vent or stack or chimney. The invention has no moving parts and is easily adaptable to stacks of different sizes. Unlike a conventional stack damper unit which is installed in the lower end of a stack, the present invention is installed at the exit end; accordingly, a single unit can stabilize draft for a furnace as well as a water heater which shares the same stack.

When the present invention is exposed to strong horizontal winds its tapered design offers little wind resistance; thus it will not significantly increase the snack toppling force of a high wind. Its primary value is to decrease updrafts caused by cross-winds. In one test which was performed using a wind tunnel to simulate a cross-wind of approximately thirty miles per hour, the invvention reduced the updraft pressure from 0.04 inches W.C. to 0.005 inches W.C. The presence of the invention at the top of a stack reduces the vacuum which would be formed at the top by a crosswind. At the same time the invention provides a streamlined closure for a stack and reduces turbulence which would otherwise be present at an uncovered stack opening and could cause uneven draft conditions.

During the start-up of a burning cycle, the invention insures that updrafts do not rob the stack of warming air which is necessary to establish initial draft flow. Accordingly, the present invention may aid in preventing a "sluggish chimney". During the burning cycle, the invention not only reduces updrafts but also sudden downdrafts of cold air. Should buildup of creosote or other combustible material cause a chimney fire, the invention will serve to limit the fire, because it will limit the extremely high draft flows necessary to support a large fire. Finally, during the non-burning phase, the invention helps protect the pilot light from extinguishment by strong downdrafts and reduces updrafts which would rob heat still present in the heat exchanger.

It will be clear from the above discussion that the present invention may be effectively used on exhaust stacks for water heaters, furnaces and fire places. It will also be clear that the present invention may be effectively used on a wide variety of other vent stacks where it is desired to stabilize the flow of combustion exhaust, air or some other gas against disturbances of the normal draft flow caused by ambient wind conditions.

It will be obvious to one skilled in the art that a number of modifications can be made to the above-described preferred embodiment without essentially changing the invention. For example, it is clear that the cones forming the upper and lower wind control caps 60, 70 may have square or hexagonal bases or other base shapes other than circular. The outlet openings may also have a variety of shapes other than circular. Accordingly, while the preferred embodiment of the invention has been described and illustrated, it is to be understood that the invention is not limited to the precise construction herein disclosed and the right is reserved to all changes and modifications coming within the scope of the invention as defined in the appended claims.

Having thus described the invention, what is claimed as new, and desired to be secured by Letters Patent, is:

1. A device for mounting at the exit end of a draft stack having a specified cross-sectional area to stabilize draft flow from the stack against the effects of ambient wind conditions, comprising:

a first cap member in the form of a concave surface, said surface having a peak angle substantially between 130° and 170°;

a second cap member in the form of a concave surface, said surface having a peak angle substantially between 130° and 170°, said second cap member having substantially the same base size and shape as and being joined to said first cap member at the edges of their respective bases, said second cap member further having a plurality of outlet openings through its surface near the edge where the first and second cap members are joined together, said outlet openings lying below the edge joining the first and second cap members and having an aggregate area not less than the specified cross-sectional area of the stack and said outlet openings further being unshielded against winds travelling substantially parallel to the plane at which the edges of the respective bases are joined; and a stack inlet opening where its peak would be located, which opening is substantially the same size as the specified cross-sectional area of the stack; and means for connecting said stack inlet opening to the exit end of said stack.

2. The stack draft stabilizing device as recited in claim 1 wherein the outlet openings through said second cap member comprise a plurality of closed plane figures of substantially equal area.

3. The draft stabilizing device as recited in claim 2 wherein the outlet openings through said second cap member are circular in shape.

4. The draft stabilizing device as recited in claim 1 wherein said first and second cap members are hollow, open-bottomed cones which have substantially circular bases and substantially aligned axes.

5. The draft stabilizing device as recited in claim 4 wherein the first and second cap members have peak angles of approximately 150° and said first and second cap members are joined together such that their sides meet at an angle of approximately 30°.

6. The draft stabilizing device as recited in claim 1 wherein the ratio of the aggregate area of the outlet openings to the specified cross-sectional area of the stack is between 1.25-to-1.0 and one-to-one.

7. The draft stabilizing device as recited in claim 1 wherein said means for connecting the stack inlet opening to the exit end of the stack comprises first connection means for insertion into the exit end of the stack and second connection means for exerting a holding force against the outside of the stack.

8. The draft stabilizing device as recited in claim 7 wherein said first connection means comprises an inner ring for insertion into the exit end of the stack and said second connection means comprises an outer ring which encircles the outside of the stack and which may be tightened against the outside of the stack.

* * * * *